US010365574B2

(12) United States Patent
Morishita

(10) Patent No.: US 10,365,574 B2
(45) Date of Patent: Jul. 30, 2019

(54) IMAGE CARRYING MEMBER UNIT AND IMAGE FORMING APPARATUS THEREWITH

(71) Applicant: KYOCERA Document Solutions Inc., Osaka (JP)

(72) Inventor: Hiroki Morishita, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/114,996

(22) Filed: Aug. 28, 2018

(65) Prior Publication Data

US 2019/0146366 A1 May 16, 2019

(30) Foreign Application Priority Data

Nov. 10, 2017 (JP) ..... 2017-217567

(51) Int. Cl.
*G03G 15/02* (2006.01)
*G03G 21/00* (2006.01)
*G03G 21/16* (2006.01)

(52) U.S. Cl.
CPC ..... *G03G 15/0225* (2013.01); *G03G 15/0233* (2013.01); *G03G 21/0076* (2013.01); *G03G 21/1671* (2013.01); *G03G 2221/0005* (2013.01)

(58) Field of Classification Search
CPC ..... G03G 15/0225; G03G 15/0233; G03G 21/0076; G03G 21/1671; G03G 2221/0005
See application file for complete search history.

(56) References Cited

U.S. PATENT DOCUMENTS 5,629,755 A * 5/1997 Ohtsuka ..... G03G 15/0225 399/176
5,873,019 A * 2/1999 Mizuishi ..... G03G 15/0225 361/225
9,335,705 B1 * 5/2016 Fukuzawa ..... G03G 15/75
2008/0124117 A1 * 5/2008 Muraishi ..... G03G 15/0225 399/100
2017/0139340 A1 * 5/2017 Morishita ..... G03G 15/0216
2017/0139341 A1 * 5/2017 Morishita ..... G03G 15/0225

FOREIGN PATENT DOCUMENTS

JP 2008-89636 A 4/2008

* cited by examiner

*Primary Examiner* — Rodney A Bonnette
(74) *Attorney, Agent, or Firm* — Stein IP, LLC

(57) ABSTRACT

An image carrying member unit has an image carrying member, a charging member, a pair of first bearing members, a biasing member, and a supporting frame. The image carrying member is rotatable, and an electrostatic latent image is formed on it. The charging member is arranged in contact or close to the image carrying member, and electrostatically charges the image carrying member. The first bearing members support the charging member movably in directions to and away from the image carrying member. The biasing member biases the charging member toward the image carrying member. The supporting frame supports the image carrying member and the first bearing members. The first bearing members each have a fulcrum rotatably supported on the supporting frame, an arm extending radially from the fulcrum, and a bearing portion formed at a tip end of the arm and supporting axially either end of the charging member.

8 Claims, 7 Drawing Sheets

IMAGE CARRYING MEMBER UNIT AND IMAGE FORMING APPARATUS THEREWITH

INCORPORATION BY REFERENCE

This application is based upon and claims the benefit of priority from the corresponding Japanese Patent Application No. 2017-217567 filed on Nov. 10, 2017, the entire contents of which are incorporated herein by reference.

BACKGROUND

The present disclosure relates to an image forming apparatus utilizing electrophotography, such as a copier, a printer, a facsimile machine, or a multifunction peripheral having their functions integrated together. More particularly, the present disclosure relates to an image carrying member unit in which an image carrying member and a charging device having a charging roller are integrated into a unit, and to an image forming apparatus provided with such an image carrying member unit.

In conventional image forming apparatuses utilizing electrophotography, a charging device is incorporated for electrostatically charging the surface of a photosensitive drum which is an image carrying member. There are known charging devices of a corona charging type in which a photosensitive drum and a corona wire are arranged with no contact with each other to electrostatically charge the surface of the photosensitive drum by corona discharge, and charging devices of a contact charging type in which a charging member such as a charging roller is arranged in contact with or close to the surface of a photosensitive drum to electrostatically charge it. However, in recent years, to reduce the amount of discharged ozone, which is harmful to the human body, the contact charging-type charging devices, which discharge less ozone, have been increasingly used.

When a charging roller is brought into contact with the surface of a photosensitive drum in such a contact charging-type charging device, a configuration is typically adopted where the rotary shaft of the charging roller is supported on a bearing member which can reciprocate in a direction perpendicular to the surface of the photosensitive drum, and the bearing member is pressed by a biasing member such as a spring so that the charging roller is put in close contact with the photosensitive drum. With the above-described configuration, by applying a proper pressing force to the charging roller, it is possible to permit the charging roller to smoothly rotate by following the photosensitive drum as it rotates.

SUMMARY

According to one aspect of the present disclosure, an image carrying member unit includes an image carrying member, a charging member, a pair of first bearing members, a biasing member, and a supporting frame. The image carrying member is rotatable, and on the image carrying member, an electrostatic latent image is formed. The charging member is arranged in contact with or close to the circumferential surface of the image carrying member, and electrostatically charges the image carrying member. The pair of first bearing members supports the charging member movably in directions to or away from the image carrying member. The biasing member biases the charging member in a direction approaching the image carrying member. The supporting frame supports the image carrying member and the first bearing members. The first bearing members each include a fulcrum rotatably supported on the supporting frame, an arm extending in a radial direction from the fulcrum, and a bearing which is formed at a tip end of the arm and which supports either end of the charging member in its axial direction.

Further features and advantages of the present disclosure will become apparent from the description of embodiments given below.

DETAILED DESCRIPTION

Figure 1:
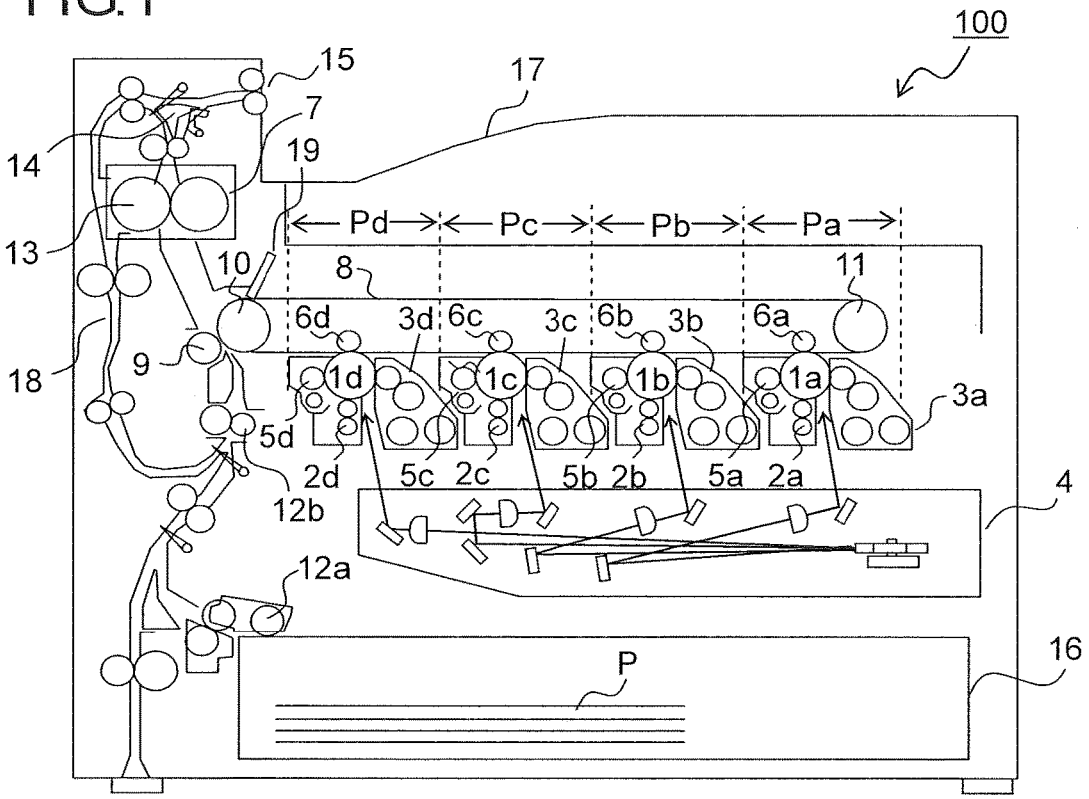
FIG. 1 is a diagram showing an outline of the construction of an image forming apparatus incorporating a drum unit according to the present disclosure.

Hereinafter, an embodiment of the present disclosure will be described with reference to the accompanying drawings. FIG. 1 is a sectional view showing an outline of the construction of an image forming apparatus 100 according to one embodiment of the present disclosure. In this embodiment, the image forming apparatus 100 is a quadruple-tandem-type color printer that performs image formation by use of four photosensitive drums 1*a*, 1*b*, 1*c*, and 1*d*, corresponding to four different colors (magenta, cyan, yellow, and black) respectively, which are arranged side by side.

Inside the image forming apparatus 100, four image forming sections Pa, Pb, Pc and Pd are arranged in this order from the right side in FIG. 1. These image forming sections Pa to Pd are provided to correspond to images of four different colors (magenta, cyan, yellow, and black) respectively, and sequentially form magenta, cyan, yellow, and black images respectively, each through the processes of electrostatic charging, exposure to light, image development, and image transfer.

In these image forming sections Pa to Pd are respectively arranged the above-mentioned photosensitive drums 1*a* to 1*d* that carry visible images (toner images) of the different colors. Moreover, an intermediate transfer belt 8 that rotates in the clockwise direction in FIG. 1 is arranged next to the image forming sections Pa to Pd. Toner images formed on these photosensitive drums 1*a* to 1*d* are sequentially transferred to the intermediate transfer belt 8 that moves while being in contact with the photosensitive drums 1*a* to 1*d*, and then the toner images are transferred all at once to a sheet P by a secondary transfer roller 9. Then, the toner images are fixed to the sheet P in a fixing device 7, and the sheet P is then discharged out of the image forming apparatus 100. An image forming process is performed with respect to each of the photosensitive drums 1*a* to 1*d* while these are rotated in the counter-clockwise direction in FIG. 1.

Sheets P to which toner images are to be transferred are stored in a sheet feed cassette 16 arranged in a lower part inside the image forming apparatus 100. The sheets P are conveyed via a feeding roller 12*a* and a registration roller pair 12*b* to the secondary transfer roller 9. As the intermediate transfer belt 8, a dielectric resin sheet is used, which typically is, for example, a seamless belt having no seam. The intermediate transfer belt 8 and the secondary transfer roller 9 are driven to rotate at the same linear velocity as the photosensitive drums 1*a* to 1*d* by a belt driving motor (unillustrated). On the downstream side of the secondary transfer roller 9, a blade-shaped belt cleaner 19 is arranged for removing toner and the like that remain on the surface of the intermediate transfer belt 8.

Figure 2:
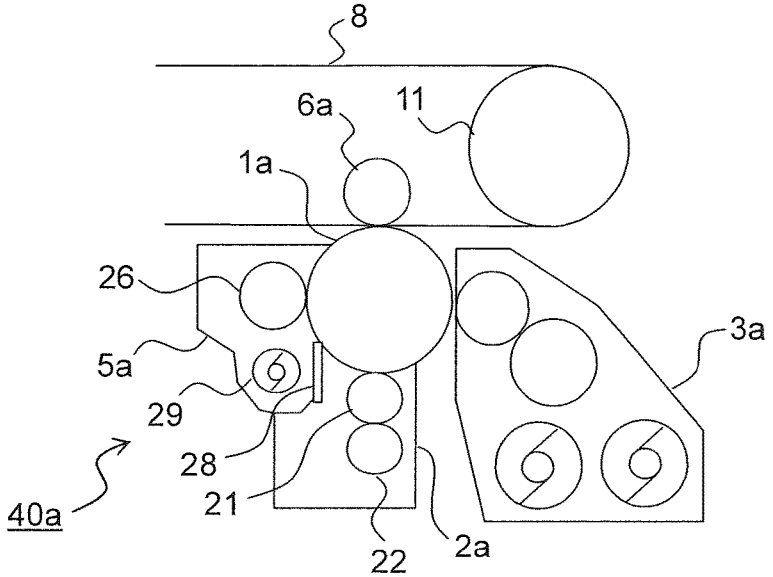
FIG. 2 is a partial sectional view around an image forming section in FIG. 1.

Now, the image forming sections Pa to Pd will be described. FIG. 2 is an enlarged partial sectional view around the image forming section Pa in FIG. 1. The image forming sections Pb to Pd have basically the same structure as the image forming section Pa, and thus no overlapping description will be repeated. Around the photosensitive drums 1*a* to 1*d*, which are rotatably arranged, there are arranged, along the drum rotation direction (the counter-clockwise direction in FIG. 2), charging devices 2*a*, 2*b*, 2*c*, and 2*d* which electrostatically charge the photosensitive drums 1*a* to 1*d*, an exposure unit 4 which exposes the photosensitive drums 1*a* to 1*d* to light based on image data, developing devices 3*a*, 3*b*, 3*c*, and 3*d* which develop, by use of toner, electrostatic latent images formed on the photosensitive drums 1*a* to 1*d*, cleaning devices 5*a*, 5*b*, 5*c*, and 5*d* which collect and remove developer (toner) left unused on the photosensitive drums 1*a* to 1*d* after toner images have been transferred, and the primary transfer rollers 6*a* to 6*d* which are arranged opposite the photosensitive drums 1*a* to 1*d* respectively across the intermediate transfer belt 8.

The photosensitive drum 1*a*, the charging device 2*a*, and the cleaning device 5*a* are integrated into a unit. In the image forming sections Pa to Pd, units composed of the photosensitive drums 1*a* to 1*d*, the charging devices 2*a* to 2*d*, and the cleaning devices 5*a* to 5*d* are hereinafter referred to as drum units 40*a* to 40*d* (image carrying member units) respectively.

The layout inside the main body of the image forming apparatus 100 can be altered as necessary as long as it is possible to properly set the rotation directions of the photosensitive drums 1*a* to 1*d* and the intermediate transfer belt 8 and the conveyance passages for sheets P. Needless to say, it is possible, for example, to reverse, as compared with this embodiment, the rotation directions of the photosensitive drums 1*a* to 1*d* and the intermediate transfer belt 8, and to reverse, as compared with this embodiment, the positional relationship of the drum units 40*a* to 40*d* and the developing devices 3*a* to 3*d*, with the conveyance passages for sheets P set accordingly.

When image data is fed in from a host device such as a personal computer, first, by charging devices 2*a* to 2*d*, the surfaces of the photosensitive drums 1*a* to 1*d* are electrostatically charged uniformly. Then, through irradiation by the exposure unit 4 with light based on the image data, electrostatic latent images based on the image data are formed on the photosensitive drums 1*a* to 1*d* respectively. The developing devices 3*a* to 3*d* have developing rollers (developer carrying members) arranged opposite the photosensitive drums 1*a* to 1*d*, and are charged with predetermined amounts of two-component developer containing toner of different colors, namely magenta, cyan, yellow, and black respectively.

When the proportion of toner contained in the two-component developer stored in the developing devices 3*a* to 3*d* falls below a predetermined value through formation of toner images, which will be described later, developer is supplied from toner containers (unillustrated) to the developing devices 3*a* to 3*d*. The toner contained in the developer is fed from the developing devices 3*a* to 3*d* onto the photosensitive drums 1*a* to 1*d*, and electrostatically attaches to them, thereby forming toner images based on the electrostatic latent images formed by exposure to light from the exposure unit 4.

Then, by primary transfer rollers 6*a* to 6*d*, a predetermined transfer voltage is applied between the primary transfer rollers 6*a* to 6*d* and the photosensitive drums 1*a* to 1*d*, and thereby the magenta, cyan, yellow, and black toner images on the photosensitive drums 1*a* to 1*d* are primarily transferred to the intermediate transfer belt 8. These images of four colors are formed in a predetermined positional relationship prescribed to form a predetermined full-color image. The primary transfer rollers 6*a* to 6*d* are driven to rotate at the same linear velocity as the photosensitive drums 1*a* to 1*d* and the intermediate transfer belt 8 by a primary transfer driving motor (unillustrated). Thereafter, in preparation for subsequent formation of new electrostatic latent images, toner left unused on the surfaces of the photosensitive drums 1*a* to 1*d* is removed by the cleaning devices 5*a* to 5*d*.

The intermediate transfer belt 8 is wound around a following roller 10 and a driving roller 11. As the driving roller 11 rotates by being driven by a belt driving motor, the intermediate transfer belt 8 rotates in the clockwise direction; meanwhile, a sheet P is conveyed from the registration roller pair 12*b*, with predetermined timing, to a nip (secondary transfer nip) between the secondary transfer roller 9, which is arranged next to the intermediate transfer belt 8, and the intermediate transfer belt 8. At the nip, a full-color image is secondarily transferred to the sheet P. The sheet P having the toner images transferred to it is conveyed to the fixing device 7.

The sheet P transported to the fixing device 7 is heated and pressed while passing through a nip (fixing nip) between a fixing roller pair 13, and thereby the toner images are fixed to the surface of the sheet P to form the predetermined full-color image. The sheet P having the full-color image formed on it is distributed between different conveyance directions by a branching portion 14 which branches into a plurality of directions. When an image is formed only on one side of the sheet P, the sheet P is discharged, as it is, onto a discharge tray 17 by a discharge roller pair 15.

On the other hand, when images are formed on both sides of the sheet P, a part of the sheet P having passed through the fixing device 7 is momentarily stuck out of the apparatus via the discharge roller pair 15. Then, the discharge roller pair 15 is rotated in the reverse direction so that the sheet P is distributed into a reverse conveyance passage 18 by the branching portion 14; thus the sheet P is, with the image side reversed, conveyed once again to the secondary transfer roller 9. Then, the next image formed on the intermediate transfer belt 8 is transferred by the secondary transfer roller 9 to the side of the sheet P on which no image has yet been formed. The sheet P is then conveyed to the fixing device 7, where the toner image is fixed, and is then discharged onto the discharge tray 17 by the discharge roller pair 15.

Figure 3:
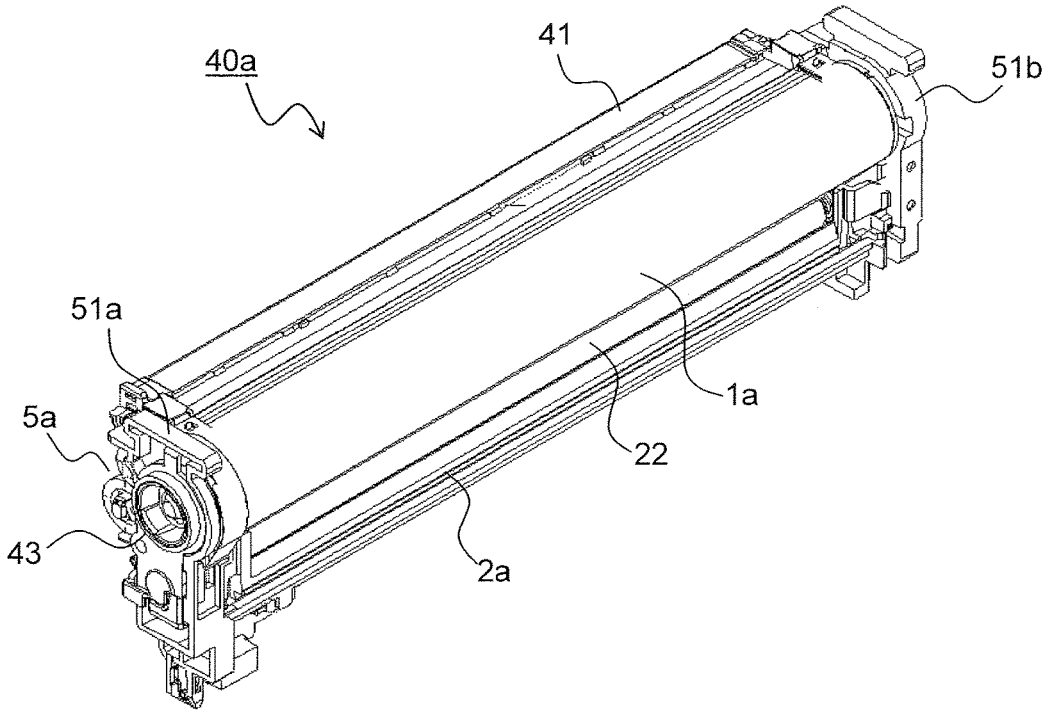
FIG. 3 is an exterior perspective view of the drum unit according to one embodiment of the present disclosure as seen from the side of one supporting frame.
Figure 4:
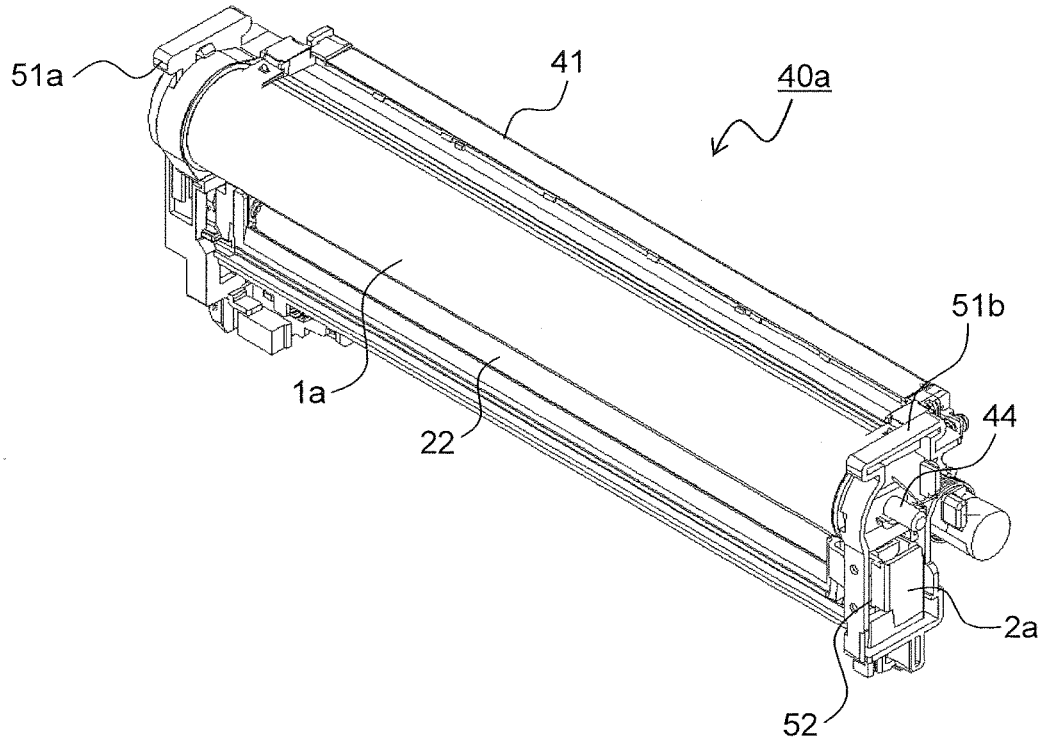
FIG. 4 is an exterior perspective view of the drum unit as seen from the side of the other supporting frame.
Figure 5:
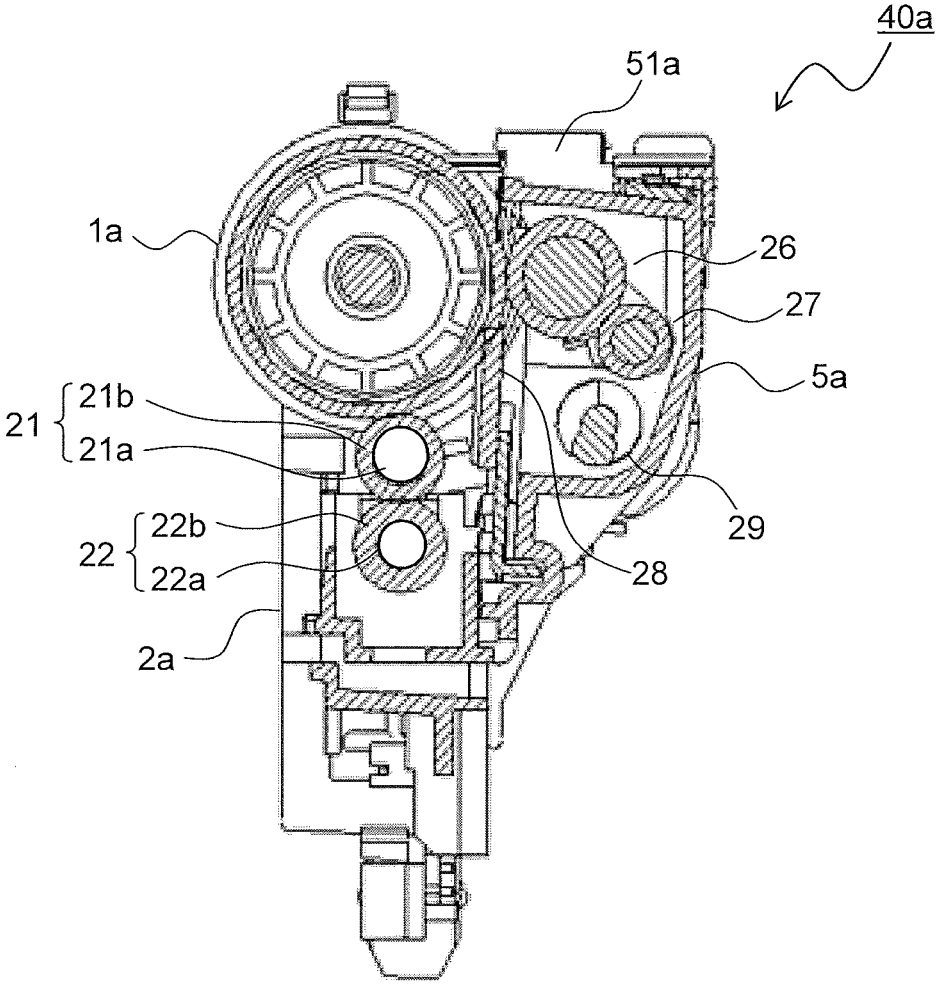
FIG. 5 is a side sectional view of the drum unit according to this embodiment.

Now, the drum units 40*a* to 40*d* used in the above-described image forming apparatus 100 will be described with reference to FIGS. 3 to 5. FIGS. 3 and 4 are perspective views of the drum unit 40*a* according to one embodiment of the present disclosure as seen from the supporting frame 51*a* side and the supporting frame 51*b* side respectively. FIG. 5 is a side sectional view of the drum unit 40*a* according to this embodiment as seen from the supporting frame 51*b* side. Below, a description will be given only of the drum unit 40*a* arranged in the image forming section Pa; the drum units 40*b* to 40*d* arranged in the image forming sections Pb to Pd are structured similarly.

As shown in FIGS. 3 and 4, the drum unit 40*a* includes the photosensitive drum 1*a*, the charging device 2*a*, the cleaning device 5*a*, and a unit case 41. To opposite end parts of the unit case 41 in the longitudinal direction, there is fitted a pair of supporting frames 51*a* and 51*b* for rotatably supporting opposite ends of the photosensitive drum 1*a* in the axial direction. As shown in FIG. 3, the supporting frame 51*a* rotatably supports a drum flange 43 formed at one end of the photosensitive drum 1*a*.

As shown in FIG. 4, the supporting frame 51*b* rotatably supports a drum rotary shaft 44 of the photosensitive drum 1*a*. In the supporting frame 51*b*, an opening 52 is formed for mounting and dismounting a charge cleaning unit 60 (see FIG. 6), which will be described later.

The charging device 2*a* includes a charging roller 21 (charging member) for applying a charging bias to the surface of the photosensitive drum 1*a* while in contact with it, and a cleaning roller 22 (cleaning member) for cleaning the charging roller 21. As shown in FIG. 5, the charging roller 21 comprises an electrically conductive rubber roller having an elastic layer 21*b* of rubber or the like formed around the circumferential surface of a metal rotary shaft 21*a*. The charging roller 21 is in pressed contact with the photosensitive drum 1*a* under a predetermined nip pressure, and rotates by following the photosensitive drum 1*a* as it rotates.

The cleaning roller 22 has a sponge-like roller portion 22*b* of rubber or resin formed around the circumferential surface of a rotary shaft 22*a*. The cleaning roller 22 rotates with the roller portion 22*b* in contact with the circumferential surface of the charging roller 21, and thereby removes toner, paper dust, and the like attached to the charging roller 21. The cleaning roller 22 is supported on the charge cleaning unit 60 (see FIG. 6), and is removably fitted to the drum unit 40*a*. Instead of the cleaning roller 22, a cleaning brush may be used that has a brush portion of resin such as electrically conductive nylon formed around the circumferential surface of a rotary shaft.

The cleaning device 5*a* includes a rubbing roller 26 (toner removing member), a toner regulating roller 27, a cleaning blade 28 (toner removing member), and a collection spiral 29. The rubbing roller 26 is in pressed contact with the photosensitive drum 1*a* under a predetermined pressure, and is driven to rotate by a drum cleaning motor (unillustrated) in the same direction as the photosensitive drum 1*a* at the plane of contact with it. The linear velocity of the rubbing roller 26 is controlled to be higher (here 1.2 times higher) than the linear velocity of the photosensitive drum 1*a*.

The rubbing roller 26 can have a structure in which a foam-material layer of EPDM rubber with an Asker C hardness of 55° is formed as a roller member around a metal shaft. The material of the roller member is not limited to EPDM rubber; instead, rubber of any other material or a foamed rubber material may be used and, for example, one with an Asker C hardness within the range of 10° to 90° can be suitably used. The rubbing roller 26 is supported on a swing bearing (unillustrated), which swings about a rotary shaft 29*a* of the collection spiral 29 as a pivot, so as to be movable in directions to and away from the photosensitive drum 1*a*.

The toner regulating roller 27 is arranged so as to be in contact with the rubbing roller 26 under a predetermined pressure, and regulates the amount of toner attached to the surface of the rubbing roller 26 to adjust the degree of polishing of the surface of the photosensitive drum 1*a*.

On the surface of the photosensitive drum 1*a*, on the downstream side of the plane of contact with the rubbing roller 26 in the rotation direction, the cleaning blade 28 is fixed in contact with the photosensitive drum 1*a*. As the cleaning blade 28, for example, a blade made of polyurethane rubber with a JIS hardness of 78° is used. The cleaning blade 28 is fitted at the point of contact with the photosensitive drum 1*a* at a predetermined angle relative to the direction tangential to the photosensitive drum 1*a*. The material, hardness, and dimensions of the cleaning blade 28, the depth and pressing force with which the cleaning blade 28 is pressed onto the photosensitive drum 1*a*, and the like can be set as necessary according to the specifications of the photosensitive drum 1*a*.

The unused toner removed from the surface of the photosensitive drum 1*a* by the rubbing roller 26 and the cleaning blade 28 is, as the collection spiral 29 rotates, discharged out of the cleaning device 5*a*. The toner used in the present disclosure is, for example, toner in which an abrasive selected from silica, titanium oxide, strontium titanate, alumina, and the like is buried in the surface of toner particles and held at the surface so as to partly protrude therefrom, or toner in which an abrasive is electrostatically attached to the toner surface.

Rotating the rubbing roller 26 at a different speed from the photosensitive drum 1*a* in this way permits the surface of the photosensitive drum 1*a* to be polished by the unused toner containing the abrasive. Then, by the rubbing roller 26 and the cleaning blade 28, water, discharge products, and the like remaining on the drum surface are removed together with the unused toner.

Figure 6:
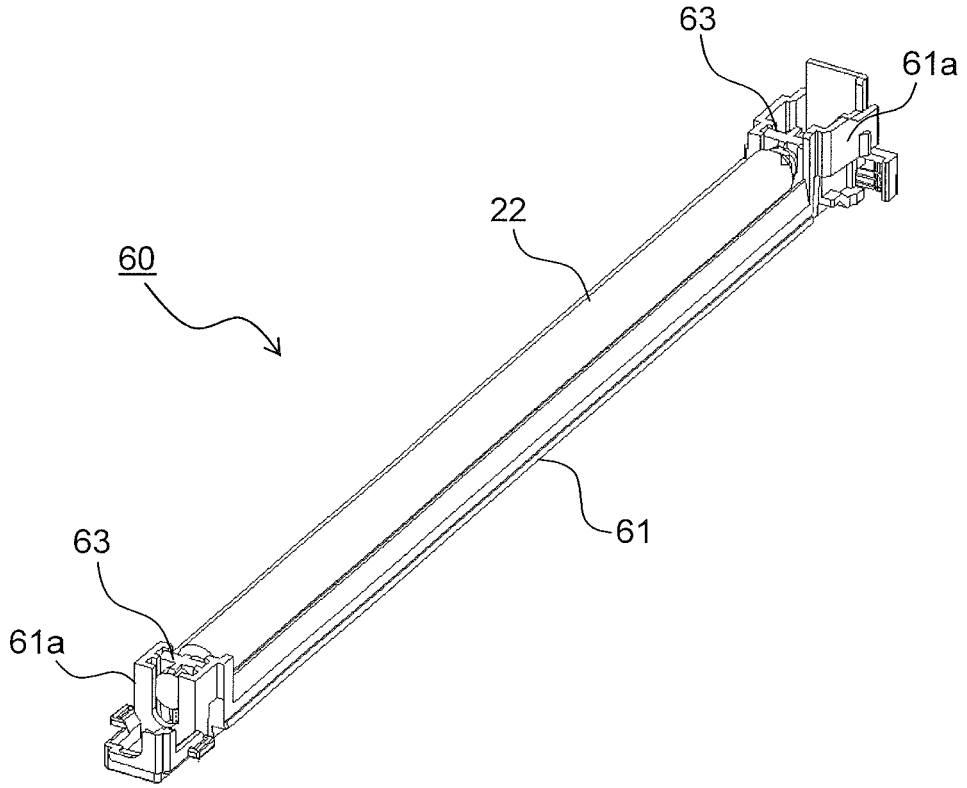
FIG. 6 is a perspective view of a charge cleaning unit removably fitted to the drum unit according to this embodiment.

FIG. 6 is a perspective view of the charge cleaning unit 60 removably fitted to the drum unit 40*a* according to this embodiment. The charge cleaning unit 60 includes a cleaning roller 22, a unit frame 61, and cleaning roller bearings 63. The cleaning roller bearings 63 rotatably support opposite end parts of the rotary shaft 22*a* of the cleaning roller 22. In opposite end parts of the unit frame 61 in its longitudinal direction, there are formed guide portions 61*a* which slidably support the cleaning roller bearings 63.

Figure 7:
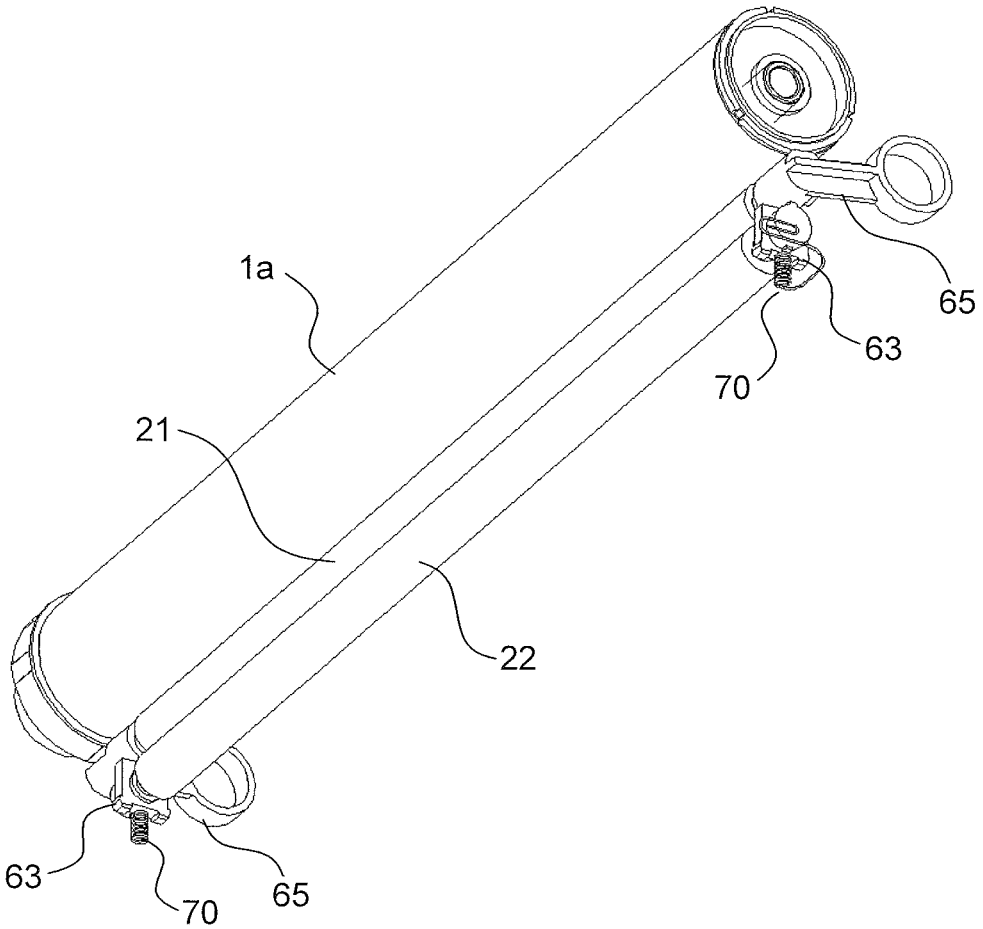
FIG. 7 is a perspective view of the supporting structure of a photosensitive drum, a charging roller, a cleaning roller in the drum unit according to this embodiment.
Figure 8:
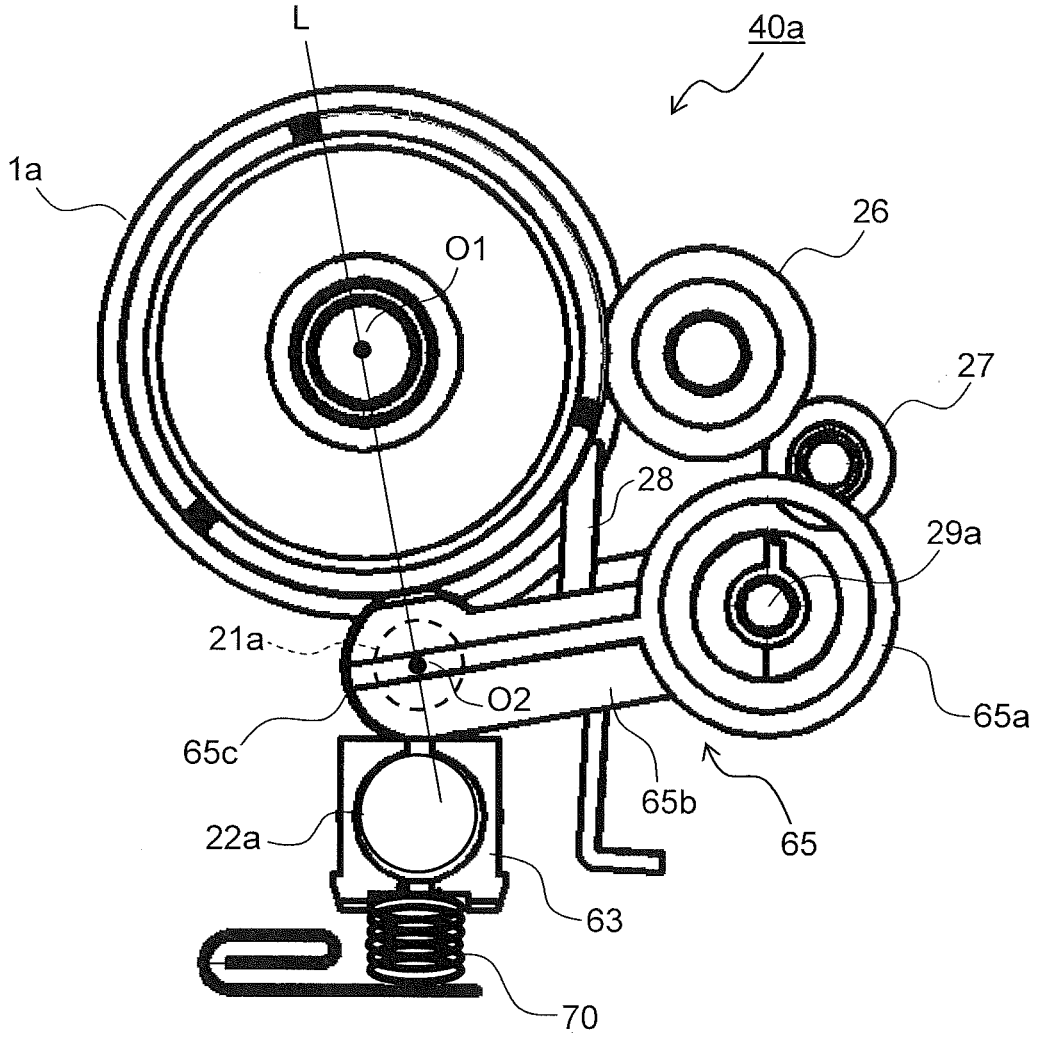
FIG. 8 is a side view of the supporting structure of the charging roller and the cleaning roller.

FIG. 7 is a perspective view of the supporting structure of the photosensitive drum 1*a*, the charging roller 21, and the cleaning roller 22 in the drum unit 40*a* according to this embodiment. FIG. 8 is a side view of the supporting structure of the charging roller 21 and the cleaning roller 22. Although FIG. 8 shows only the supporting frame 51*b*-side (upper right-side in FIG. 7) structure of the drum unit 40*a*, the supporting frame 51*a*-side structure is similar.

At opposite end parts of the charging roller 21 in its axial direction, there is arranged a pair of charging roller bearings 65 (first bearing members) which rotatably supports the rotary shaft 21*a* of the charging roller 21. The charging roller bearing 65 is formed of electrically conductive resin, and via the charging roller bearing 65, a charging voltage is applied to the charging roller 21.

As shown in FIG. 8, the charging roller bearing 65 includes a fulcrum 65*a* rotatably supported on the supporting frame 51*b*, an arm 65*b* extending in a radial direction from the fulcrum 65*a*, and a bearing portion 65*c* which is formed at a tip end of the arm 65*b* and which rotatably supports either end of the rotary shaft 21*a* of the charging roller 21. The fulcrum 65*a* is supported coaxially with the rotary shaft 29*a* of the collection spiral 29.

A coil spring 70 (biasing member) is arranged in contact with a bottom part of the cleaning roller bearing 63 (second bearing member). The coil spring 70 is arranged between the cleaning roller bearing 63 and the bottom face of the unit frame 61, and biases the cleaning roller 22 via the cleaning roller bearing 63 toward the charging roller 21 (upward in FIG. 8). With the biasing force of the coil spring 70, the charging roller 21 is pressed uniformly in contact with the surface of the photosensitive drum 1*a* via the cleaning roller bearing 63 and the charging roller bearing 65, and rotates by following the photosensitive drum 1*a* as it rotates.

The photosensitive drum 1*a* is rotatably supported on drum bearings (unillustrated) formed on the supporting frames 51*a* and 51*b*. On the drum flange 43 (see FIG. 3) formed at one end (the supporting frame 51*a*-side end) of the photosensitive drum 1*a*, a drum-side gear (unillustrated) is formed. To one end of the rotary shaft 22*a* of the cleaning roller 22, a roller-side gear (unillustrated) is fixed.

As the drum-side gear rotates as the photosensitive drum 1*a* rotates, the rotation driving force of the drum-side gear is transmitted via an idle gear (unillustrated) to the roller-side gear. By the rotation driving force, the cleaning roller 22 is driven to rotate while keeping a linear velocity difference relative to the charging roller 21. Thereby, toner, paper dust, and the like attached to the charging roller 21 are removed.

With the above-described structure, the charging roller bearings 65 which rotatably support the charging roller 21 are swingably supported on the supporting frames 51*a* and 51*b*; this prevents the charging roller 21 from vibrating in the circumferential direction of the photosensitive drum 1*a* (the left-right direction in FIG. 8), and thus permits the charging roller 21 to rotate smoothly by following the photosensitive drum 1*a* as it rotates. As a result, it is possible to effectively suppress the occurrence of an uneven charge distribution resulting from the vibration of the charging roller 21.

The bearing portion 65*c* of the charging roller bearing 65 is biased toward the photosensitive drum 1*a* by the biasing force of the coil spring 70 arranged in the charge cleaning unit 60. Thus, when the charge cleaning unit 60 is removed, the pressure of the charging roller 21 against the photosensitive drum 1*a* is eliminated. Thus, when the drum unit 40*a* is transported or kept in storage, with the charge cleaning unit 60 removed, it is possible to prevent sagging of the charging roller 21 and contamination of the photosensitive drum 1*a* resulting from bleeding of plasticizer from the elastic layer 21*b* of the charging roller 21. Also no member for holding the charging roller 21 and the photosensitive drum 1*a* apart from each other is necessary any longer.

The rotary shaft 29*a* of the collection spiral 29 is supported on the supporting frames 51*a* and 51*b* so as to penetrate the drum unit 40*a* in its longitudinal direction, and is positioned in the drum unit 40*a*. With the fulcrum 65*a* of the charging roller bearing 65 supported coaxially with the rotary shaft 29*a*, it is possible to accurately and stably support the charging roller 21.

Although it is possible to support the fulcrum 65*a* of the charging roller bearing 65 at a position other than that of the rotary shaft 29*a*, to put the charging roller 21 into and out of contact with the photosensitive drum 1*a* perpendicularly to it, it is preferable that the fulcrum 56*a* be positioned such that the arm 65*b* is substantially perpendicular to the straight line L that passes through the axial center O1 of the photosensitive drum 1*a* and the axial center O2 of the charging roller 21. In this embodiment, with the fulcrum 65*a* arranged coaxially with the rotary shaft 29*a*, it is possible to arrange the arm 65*b* perpendicular to the straight line L.

Even with the arm 65*b* perpendicular to the straight line L, the orbit of the charging roller 21 is arc-shaped when the arm 65*b* is given a small arm length. The rotary shaft 29*a* is arranged at a predetermined distance from the photosensitive drum 1*a*, and thus it is possible to give the arm 65*b* a large arm length. As a result, it is possible to put the charging roller 21 into and out of contact with the photosensitive drum 1*a* in a direction perpendicular to the photosensitive drum 1*a* (in a radial direction of the photosensitive drum 1*a*) and in addition rectilinearly.

With the opening 52 (see FIG. 4) formed in the supporting frame 51*b*, it is possible, through the opening 52, to pull out and insert the charge cleaning unit 60 from and into the unit case 41 in the axial direction. This facilitates the replacement and maintenance of the charge cleaning unit 60.

The embodiments described above are in no way meant to limit the present disclosure, which thus allows for many modifications and variations within the spirit of the present disclosure. For example, although this embodiment deals with the drum units 40*a* to 40*d* provided with the charging roller 21 which rotates, while in contact with the photosensitive drums 1*a* to 1*d*, by following the photosensitive drums 1*a* to 1*d* as they rotate, the present disclosure is applicable equally to drum units 40*a* to 40*d* provided with a charging roller 21 which is arranged close to the photosensitive drums 1*a* to 1*d* in a non-contact state with them.

The charging roller 21 does not electrostatically charge the surface of the photosensitive drum 1*a* at a place (nip) where the charging roller 21 makes contact with the photosensitive drum 1*a*, but electrostatically charges the surface of the photosensitive drum 1*a* by discharge at a position away from the place of contact in the circumferential direction. That is, even with the charging roller 21 arranged close to the photosensitive drums 1*a* to 1*d*, it is possible to suppress micro-vibration and thus to suppress uneven charge distribution on the surfaces of the photosensitive drums 1*a* to 1*d*.

Although the above-described embodiment deals with the drum unit 40*a* in which the cleaning roller 22 only rotates and does not reciprocate in the axial direction, for example, even with a configuration where the cleaning roller 22, while rotating, reciprocates in the axial direction, by supporting the rotary shaft 21*a* of the charging roller 21 by use of the charging roller bearing 65 including the fulcrum 65*a*, the arm 65*b*, and the bearing portion 65*c*, it is possible to effectively prevent the vibration of the charging roller 21.

The present disclosure is applicable, not only to tandem-type color printers like the one shown in FIG. 1, but also to various image forming apparatuses provided with a drum unit in which a photosensitive drum and a charging device are integrated into a unit, examples including digital and analog monochrome copiers, monochrome printers, color copiers, facsimile machines, and the like.

The present disclosure finds application in image carrying member units provided with a charging member supported to be movable in directions to and away from an image carrying member. Based on the present disclosure, it is possible to provide an image carrying member unit that can effectively prevent the occurrence of an uneven charge distribution resulting from the vibration of a charging member and that can satisfactory maintain a state where the charging member and an image carrying member are in contact with or close to each other, and to provide an image forming apparatus provided with such an image carrying member unit.

What is claimed is:

1. An image carrying member unit comprising:

an image carrying member which is rotatable and on which an electrostatic latent image is formed;

a charging member arranged in contact with or close to a circumferential surface of the image carrying member, the charging member electrostatically charging the image carrying member;

a pair of first bearing members which supports the charging member movably in directions to or away from the image carrying member;

a biasing member which biases the charging member in a direction approaching the image carrying member; and a supporting frame which supports the image carrying member and the first bearing members, wherein the first bearing members each include:

a fulcrum rotatably supported on the supporting frame;

an arm extending in a radial direction from the fulcrum; and a bearing portion formed at a tip end of the arm, the bearing portion supporting either end of the charging member in an axial direction thereof, the image carrying member unit further comprises:

a cleaning member which cleans the charging member while rotating in contact with a circumferential surface of the charging member; and a pair of second bearing members which rotatably supports opposite end parts of the cleaning member in the axial direction, the cleaning member makes contact with the charging member from a direction opposite from the image carrying member, and the biasing member biases the second bearing members in the direction approaching the image carrying member, and thereby biases the charging member via the cleaning member in the direction approaching the image carrying member, a charge cleaning unit in which the cleaning member, the second bearing members, and the biasing member are held integrally on a unit frame, the charge cleaning unit being removably fitted to the supporting frame, and the charging member is pressed against the image carrying member when the charge cleaning unit is fitted to the supporting frame, and a pressure against the image carrying member is eliminated when the charge cleaning unit is removed from the supporting frame.

2. The image carrying member unit of claim 1, wherein the first bearing members each have the fulcrum rotatably supported at such a position that the arm is perpendicular to a straight line that passes through an axial center of the image carrying member and an axial center of the charging member.

3. The image carrying member unit of claim 2, wherein the fulcrum is arranged at a predetermined distance from the image carrying member, and as the arm swings, the charging member reciprocates rectilinearly in a radial direction of the image carrying member.

4. An image forming apparatus comprising:

the image carrying unit of claim 1; and an image forming section to which the image carrying member unit is removably fitted, the image forming section forming an image on a sheet.

5. An image carrying member unit comprising:

an image carrying member which is rotatable and on which an electrostatic latent image is formed;

a charging member arranged in contact with or close to a circumferential surface of the image carrying member, the charging member electrostatically charging the image carrying member;

a pair of first bearing members which supports the charging member movably in directions to or away from the image carrying member;

a biasing member which biases the charging member in a direction approaching the image carrying member; and a supporting frame which supports the image carrying member and the first bearing members, wherein the first bearing members each include:

a fulcrum rotatably supported on the supporting frame;

an arm extending in a radial direction from the fulcrum; and a bearing portion formed at a tip end of the arm, the bearing portion supporting either end of the charging member in an axial direction thereof, the image carrying member unit further comprises:

a toner removing member which removes toner left unused on the circumferential surface of the image carrying member; and a collection spiral which discharges toner removed by the toner removing member out of the image carrying member unit, and the fulcrum is supported coaxially with a rotary shaft of the collection spiral.

6. The image carrying member unit of claim 5, wherein the first bearing members each have the fulcrum rotatably supported at such a position that the arm is perpendicular to a straight line that passes through an axial center of the image carrying member and an axial center of the charging member.

7. The image carrying member unit of claim 6, wherein the fulcrum is arranged at a predetermined distance from the image carrying member, and as the arm swings, the charging member reciprocates rectilinearly in a radial direction of the image carrying member.

8. The image carrying member unit comprising:

the image carrying unit of claim 5; and an image forming section to which the image carrying member unit is removably fitted, the image forming section forming an image on a sheet.

* * * * *